US005472219A

United States Patent [19]

Eckstrum

[11] Patent Number: 5,472,219

[45] Date of Patent: Dec. 5, 1995

[54] COMBINATION AUTOMOTIVE CREEPER AND BRAKING APPARATUS THEREFORE

[76] Inventor: Kurt C. Eckstrum, 630 Morrison Ave., Palatine, Ill. 60067

[21] Appl. No.: 280,484

[22] Filed: Jul. 26, 1994

[51] Int. Cl.[6] ..... B25H 5/00

[52] U.S. Cl. ..... 280/32.6; 188/5

[58] Field of Search ..... 280/32.6; 188/5

[56] References Cited

U.S. PATENT DOCUMENTS

| | | | |
|---|---|---|---|
| 920,553 | 5/1909 | Farlan | 280/32.6 |
| 1,349,941 | 8/1920 | Broome | 280/32.6 |
| 1,446,945 | 2/1923 | Sunderland | 280/32.6 |
| 1,451,858 | 4/1923 | Zengerle | 280/32.6 |
| 2,154,952 | 4/1939 | Mahlock | 280/32.6 |
| 2,210,585 | 8/1940 | Hulbert | 280/32.6 |
| 2,684,734 | 7/1954 | Wilson | 188/74 |
| 2,780,472 | 2/1957 | Mullin | 280/32.6 |
| 2,879,865 | 3/1959 | Simmons | 188/69 |
| 2,942,693 | 6/1960 | Johnson | 188/5 |
| 3,361,437 | 1/1968 | Loftis | 280/32.6 |
| 4,244,594 | 1/1981 | Hines | 280/32.6 |
| 4,570,957 | 2/1986 | Rose | 280/32.6 |
| 4,815,569 | 3/1989 | Norman | 188/5 |
| 4,925,197 | 5/1990 | Jones, Jr. | 280/32.6 |
| 5,022,670 | 6/1991 | Cote | 280/32.6 |
| 5,108,118 | 4/1992 | Schaevitz | 280/32.6 |
| 5,174,592 | 12/1992 | Pool | 280/32.6 |
| 5,213,350 | 5/1993 | Hermanson | 280/32.6 |
| 5,378,003 | 1/1995 | Burd et al. | 280/32.6 |

*Primary Examiner*—Josie A. Ballato
*Attorney, Agent, or Firm*—Charles F. Meroni, Jr.

[57] ABSTRACT

An automotive creeper structure for an automotive mechanic to facilitate repairs to disabled vehicle including a creeper frame, a pad structure on the frame, swivel-like mounted casters secured to the frame to effectuate movement of the creeper structure. Parallel camming bars positioned on opposite sides of the pad structure, vertically movable creeper brake shoes mounted on the creeper frame for ground engagement. Structure is independently connected to each of the parallel camming bars and connected to an associated one of the vertically movable creeper brake shoes for causing an associated one of the vertically movable creeper brake shoes to move into braking contact with a ground surface underlying the creeper frame. The present invention also provides for a pair of individually hand operated handles supported on the creeper frame for individually and independently actuating an associated one of the vertically movable creeper brake shoes causing the associated one of the shoes to move up into a storage position and down into a ground engagement position for use by the mechanic.

25 Claims, 5 Drawing Sheets

COMBINATION AUTOMOTIVE CREEPER AND BRAKING APPARATUS THEREFORE

BACKGROUND OF THE INVENTION

Field of the Invention

The present invention relates generally to an automotive mechanic's creeper for allowing a mechanic to slide underneath an automotive vehicle to effectuate repairs. More particularly, it relates to an improved braking system for an automotive creeper which allows an automotive mechanic to ergonomically and comfortably position his or her body relative to the creeper beneath the vehicle in such a manner that the mechanic may then efficiently expedite repairs to the vehicle.

Description of the Prior Art

The automotive industry has undergone a great transformation in recent years. Automotive engineers and designers have experienced rapidly growing pressure to develop vehicles that fit within the guidelines of ever increasing state and federal regulation. Major areas of recent government regulation in the automotive industry include vehicle safety, fuel economy, and pollution emissions. As a result of these new governmental pressures on the industry, automobile manufacturers have introduced new models which are often characterized by a radically reduced engine compartment size. In many cases, new automotive technologies, such as computer systems, fuel injection devices, and new engine designs have resulted in the development of powerful engines and power trains which are of a smaller physical size than earlier automotive models. In addition, these new technologies and their corresponding reduced size often provide a more aerodynamic design of the entire vehicle itself. However, the reduction of physical space in the engine compartment has also created a new set of challenges for the vehicle mechanic who must physically effectuate repairs on the vehicle. One such challenge is that the mechanic may only be physically able to reach the desired portion of the vehicle from the underside of the vehicle. As a result, the mechanic may be required to work directly within a cramped space while laying in a prone position underneath the vehicle. Certain repairs will undoubtedly require the mechanic to carefully position his or her body relative to the creeper and the vehicle at such an angle that he or she is freely able to work on the vehicle without either physically injuring the mechanic or placing the mechanic in a situation where he or she could be harmed by the vehicle. Moreover, a large number of vehicle repairs, such as brake and rear-end work, traditionally require the mechanic to position him or herself underneath the desired position of the vehicle.

A number of devices are disclosed in the prior art which attempt to provide a mechanic's creeper suitable for allowing a mechanic to lay underneath a vehicle while the mechanic physically performs repairs to the vehicle. For example, U.S. Pat. No. 4,925,197 by Jones discloses a Pivotal Creeper having two body portions which employ a swivel joint. In addition, the U.S. Prior Art is known to teach an Adjustable Variable Slope Elevating Creeper which has an automotive creeper having a platform which can lift and elevate the body of the mechanic relative to the precise to type of work needed to be performed upon the vehicle. While these types of creepers found in the prior art may allow a mechanic to position him or herself beneath a vehicle, they universally fail to provide a proper braking feature which places the creeper in ground engagement thereby preventing the mechanic from moving or shifting out of the chosen position. By allowing the mechanic to remain in a fixed position without any unnecessary and undesired movement, the mechanic can proceed with the required repairs in a more efficient manner. In this manner, complex repairs, such as the replacement of parts can be performed more quickly. In addition, fixed placement of the mechanic can allow for greater physical manipulation of repair tools thereby preventing the mechanic from moving and possibly dropping a tool from an overhead position onto the body of the mechanic and causing injury.

Furthermore, in recent years a new generation of automotive products commonly known as Sport Utility Vehicles have gained widespread popularity among consumers. Many of these Sport Utility Vehicles are designed to be used in a recreational or "off-road" capacity. As a result, an increased number of repairs may be needed to be performed in outdoor terrain which is commonly uneven, sloped, and inclined. Once again, the present invention distinguishes the prior art in this area by providing the ability to vertically position itself on a sloped or inclined surface so that the mechanic remains in a horizontal and level position while underneath the vehicle. This horizontal and level positioning of the mechanic can prevent inadvertent blood flow to the mechanic's extremities, especially with regard to the mechanic's head which could result in disorientation and possible injury to the mechanic with respect to the vehicle and any tools used.

SUMMARY OF THE INVENTION

My invention provides a creeper structure including a creeper frame, a pad structure on the frame, swivel-like mounted casters secured to the frame beneath the pad structure. The present invention is further defined by parallel camming bars positioned on opposite sides of the pad structure and vertically movable creeper brake shoes mounted on the creeper frame beneath the pad structure for ground engagement, means independently connected to each of parallel camming bars and connected to an associated one of the vertically movable creeper brake shoes for causing an associated one of the vertically movable creeper brake shoes to move into braking contact with a ground surface underlying the creeper frame. I have also disclosed a pair of individually hand operated handles supported on the creeper frame for individually and independently actuating an associated one of the means mounted in the parallel camming bars as well as an associated one of the vertically movable creeper brake shoes causing the associated one of the shoes to move up into a rest position and down into a ground engagement position. My invention also provides for a creeper structure wherein the handles are angled away from the side rails when positioned to the creeper brake shoes in ground engagement. In addition, features of my invention contemplate a creeper structure wherein the handles are in generally parallel relation to one another and parallel to the parallel camming bars when the creeper brake shoes are in the storage position. My invention also provides for a creeper structure wherein the handles are angled away from the side rails when positioned with the creeper brake shoes in ground engagement and being in generally parallel relation to one another and parallel to the parallel camming bars when the creeper brake shoes are in the storage position.

My invention also provides in combination, creeper structure including a creeper frame, a pad structure on the frame, swivel-like mounted casters secured to the frame beneath the pad structure. I have provided parallel camming bars positioned on opposite sides of the pad structure, vertically movable creeper brake shoes mounted on the creeper frame beneath the pad structure for ground engagement. Means are independently connected to each of the parallel camming bars and connected to the vertically movable creeper brake shoes for causing an associated one of the vertically movable creeper brake shoes to move into braking contact with a ground surface underlying the creeper frame. My combination further comprises a pair of individually hand operated handles supported on the creeper frame for individually and independently actuating an associated one of the means mounted in the parallel camming bars as well as an associated one of the vertically movable creeper brake shoes causing the shoes to move up into a rest position and down into a ground engagement position. Still other important features of my invention provide for the combination wherein the handles are angled away from the side rails when positioned to the creeper brake shoes in ground engagement. My invention further provides for the combination wherein the handles are in generally parallel relation to one another and parallel to the parallel camming bars when the creeper brake shoes are in the storage position. Further, my invention additionally contemplates the combination wherein the handles are angled away from the side rails when positioned with the creeper brake shoes in ground engagement and being in generally parallel relation to one another and parallel to the parallel camming bars when the creeper brake shoes are in the storage position.

Accordingly, it is a primary object of my invention to provide a creeper structure having an improved braking system for an automotive creeper which allows an automotive mechanic to ergonomically and comfortably position his or her body relative to the creeper beneath the vehicle in such a manner that the mechanic may then efficiently expedite repairs to the vehicle.

Another object of my invention is to provide vertically movable creeper brake shoes which are manually actuated by the mechanic for ground engagement to place the mechanic in a fixed position to effectuate repairs to a vehicle whereby the mechanic will not unintentional move or slide with the creeper regardless of whether the creeper is placed upon a non-level, uneven, or inclined ground surface.

A further object of my invention is to provide a automotive creeper structure which allows a mechanic to effectuate repairs upon an automotive vehicle of a more difficult nature in that the creeper structure will allow the mechanic to place him or herself in a position to make repairs in the tight, cramped spaces of many late model automotive vehicles.

Yet another object of my invention is to allow for the fixed placement of the mechanic by virtue of the creeper brake shoes affording greater physical manipulation of repair tools by the mechanic thereby preventing the mechanic from moving and possibly dropping a tool from an overhead position onto the body of the mechanic and causing injury.

A still further object of my invention is to provide an automotive creeper which utilizes the vertical creeper brake shoes to position the mechanic on a horizontal or level plane, regardless of the surface the creeper is placed upon, thereby preventing inadvertent blood flow to the mechanic's extremities, especially the mechanic's head which could result in disorientation and possible injury to the mechanic with respect to the vehicle and any tools used by the mechanic.

Additional objects, advantages and features of the present invention will become apparent from the following description and appended claims, taken in conjunction with the accompanying drawings.

BRIEF DESCRIPTION OF THE DRAWINGS

A more complete appreciation of the invention and many of the attendant advantages thereof will be readily apparent as the same becomes better understood with reference to the following detailed description when considered in connection with the accompanying drawings wherein.

DETAILED DESCRIPTION OF THE INVENTION

Figure 1:
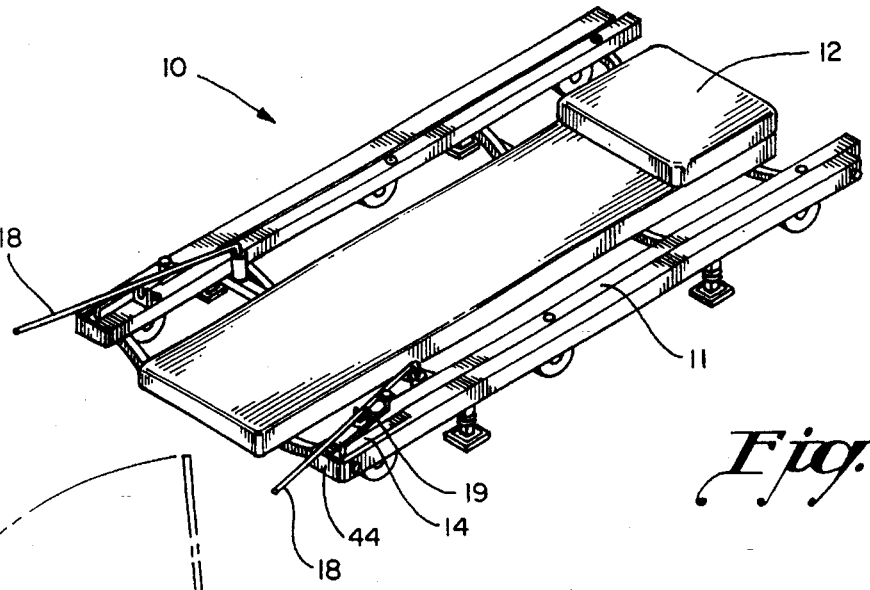
FIG. 1 is a perspective view of the creeper structure of the present invention showing the creeper brake shoes.

Referring now to the drawings, FIG. 1 shows my invention which relates to a creeper structure 10 including a creeper frame 11, the frame 11 being adapted for having a pad structure 12 mounted thereon for the comfort of the mechanic or other user. My invention could be manually moved by the mechanic by swivel-like mounted casters 13 secured to the frame 11 beneath the pad structure 12.

Figure 9:
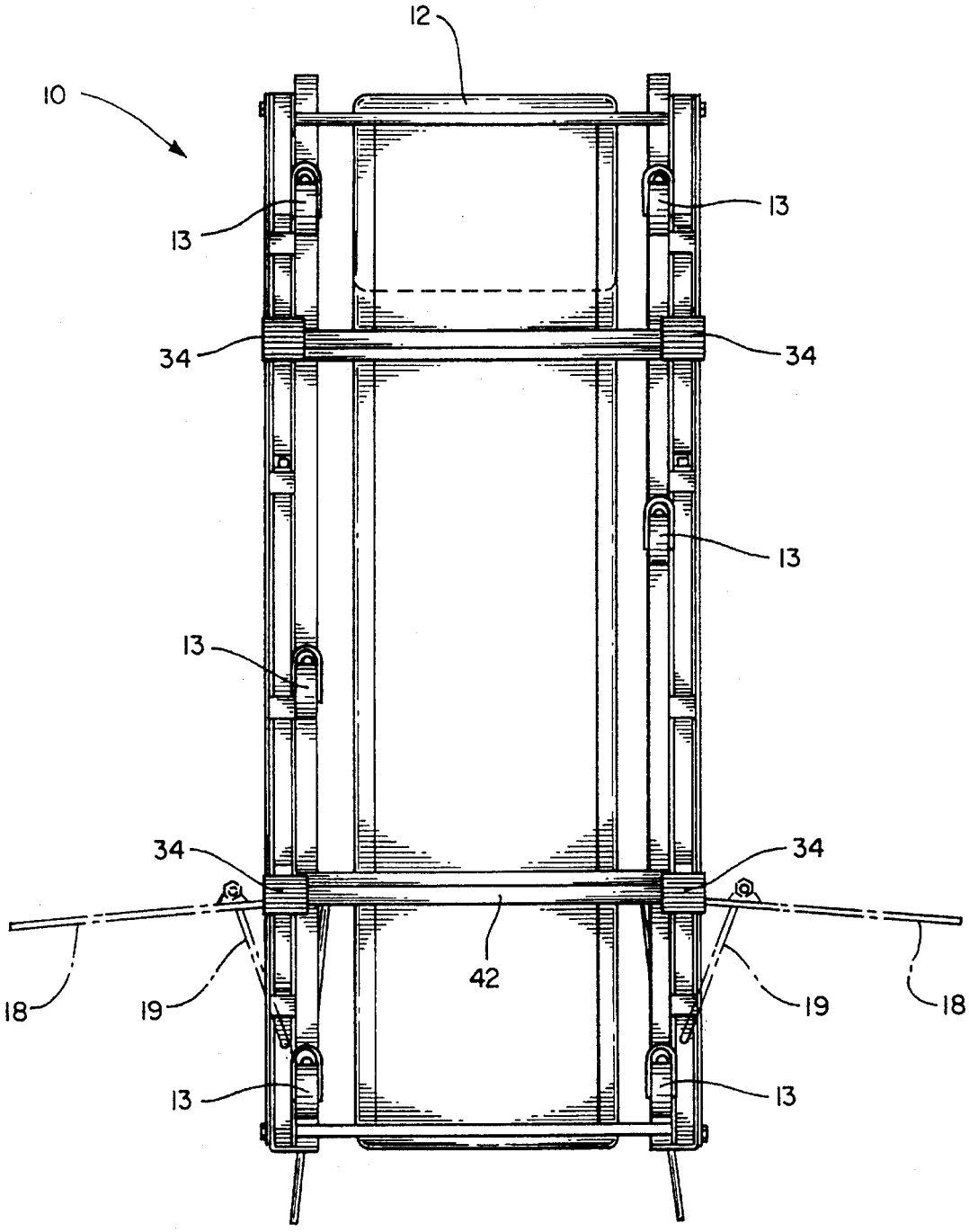
FIG. 9 is a bottom view of the creeper structure of the present invention showing the creeper brake shoes.
Figure 10:
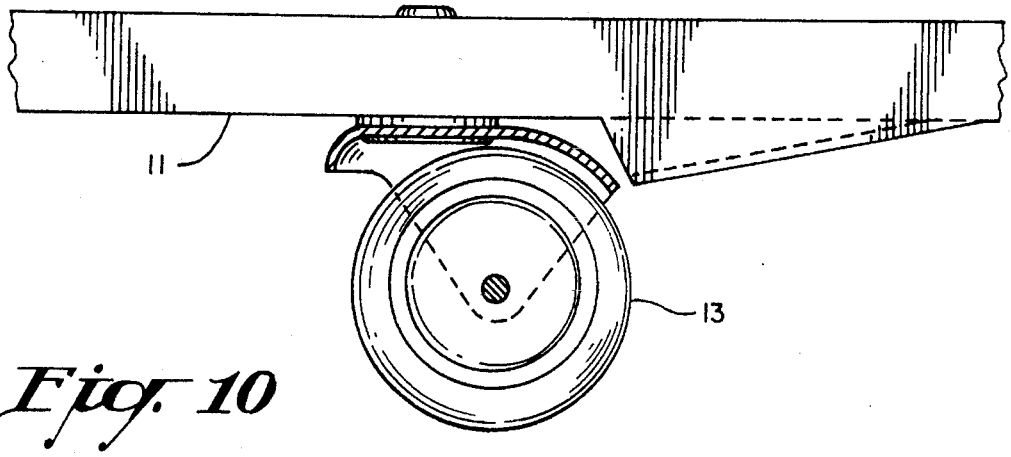
FIG. 10 is a partial side of my creeper structure showing a caster.

As best illustrated in FIG. 9, a pair of swivel-like mounted casters 13 positioned towards the middle of the frame 11 are staggered longitudinally relative to one another. This offset caster wheel orientation provides additional stability to the creeper structure 10. It will be observed that in FIG. 9 I have provided six casters 13 and that a middle pair of the casters are staggered with regard to one another as the end pairs of casters are positioned in rows, where the casters are across from one another. Considering the casters from end to end, it will be seen that two rows of end to end related casters are provided and that these casters extend beneath the frame 11.

It will be appreciated that the pad structure 12 can provided with a padded cushion having a durable surface and that the swivel-like mounted casters 13 can be disposed on a horizontal plane with the creeper frame 11.

Figures 7, 7A, 8:
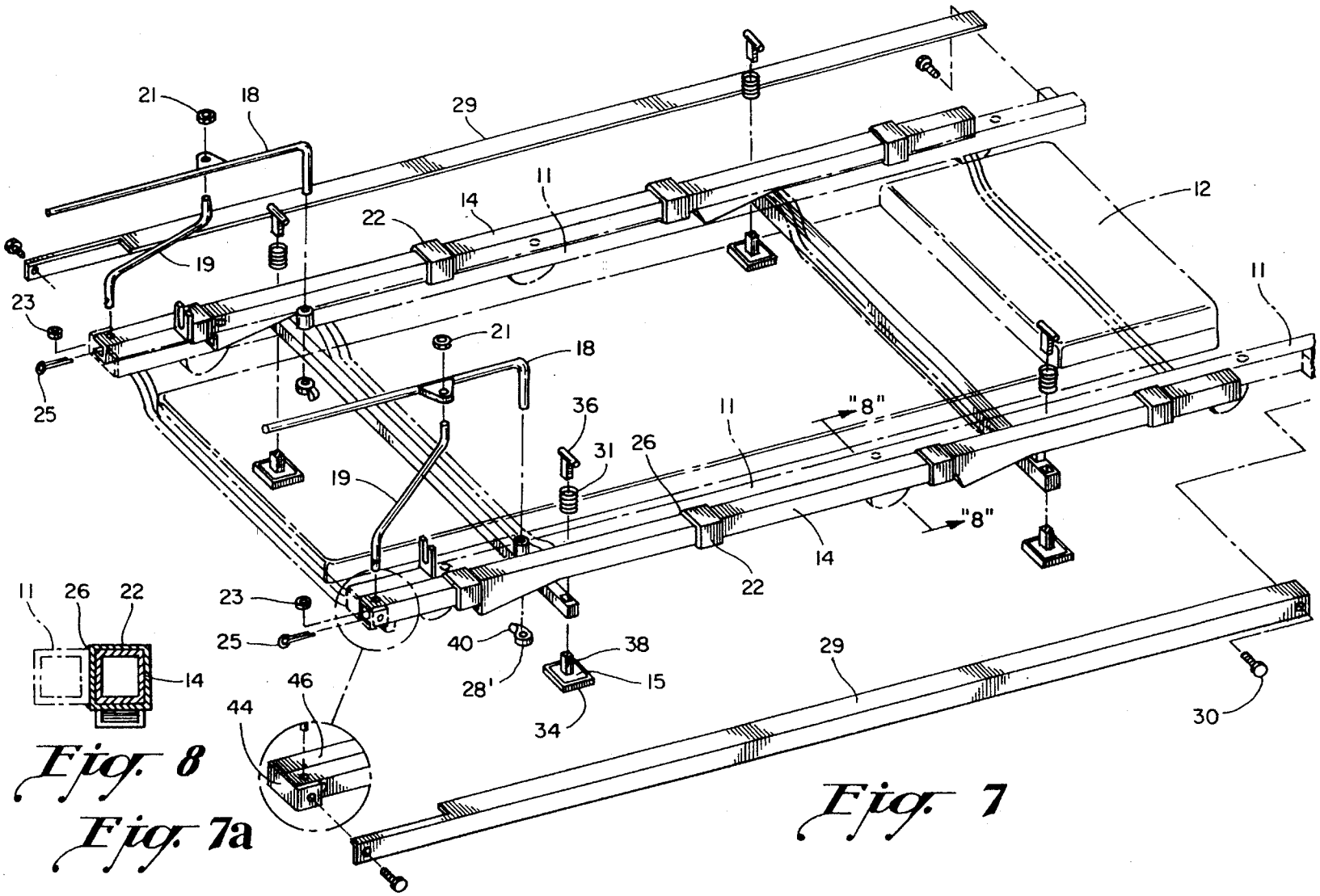
FIG. 7 is an exploded diagrammatic view of my creeper structure.
FIG. 8 is a cross-sectional view taken through line 8—8 of FIG. 7.

Referring now to FIG. 7, an important feature of my invention is the improvement of parallel camming bars 14 positioned on opposite sides of the pad structure 12 and vertically movable creeper brake shoes 15 mounted on the creeper frame 11. Additionally, one of the parallel camming bars 14 may be notched so that one the middle staggered casters 13 will be able to spin free of the camming bar 14.

My invention further provides means independently connected to each of the parallel camming bars 14 and connected to an associated one of a vertically movable creeper brake shoes 15 for causing an associated one of the vertically movable creeper brake shoes 15 to move into braking contact with the ground surface 17 underlying the creeper frame 11. The means of my invention can comprise a responsive camming bar means or cam means, a gear means, a sliding gear means capable of being engaged and disengaged, or where the sliding gear is linked to a slideable spring loaded cylinder capable of maintaining the gear means in an engaged position.

A pair of individually hand operated handles 18 supported on said creeper frame 11 are provided for individually and independently actuating an associated one of the means mounted in said parallel camming bars 14 as well as an associated one of said vertically movable creeper brake shoes 15 causing the associated one of the shoes 15 to move up into a rest position and down into a ground engagement position by a spring 31. The vertically movable creeper brake shoes 15 comprises an actuator head 36 is inserted through a spring 31 and connects to a lower brake shoe end 38. Preferably, rubber brake shoe pads 34 are attached to a bottom side of the lower brake shoe end 38 of the vertically movable creeper brake shoes 15 to provide additional gripping when the creeper brake shoes 15 engage a ground surface 17.

An important feature of my invention revolves around the components comprising the means to independently and individually actuate an associated one of the creeper brake shoes. It will be appreciated that the means can comprise a responsive camming bar actuator 19 individually connected to each of the parallel camming bars 14 by a responsive pivot 23 which secures the camming bar actuator 19 to the parallel side rail 14 by a pin or key-shaped linking member 25.

Figure 11:
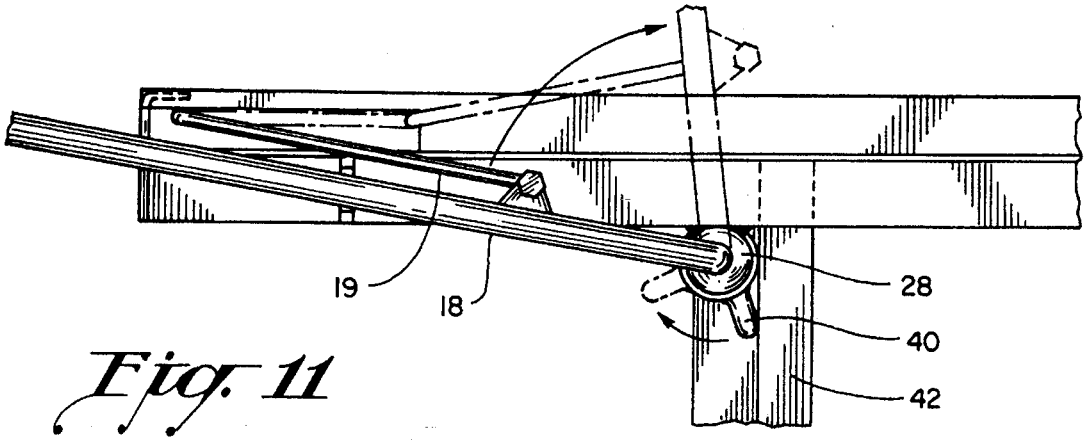
FIG. 11 is a partial top view of the creeper structure showing the handles in a resting state and an actuating state.
Figure 12:
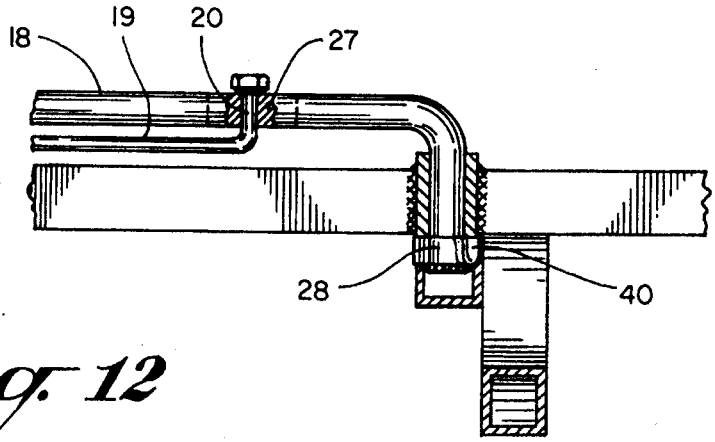
FIG. 12 is a partial cross-sectional view of the creeper structure of the present invention showing the handle mounted in a swivel-pivot linkage mechanism.

As shown in FIG. 11, the handles 18 and camming bar actuator 19 can be positioned in a resting state and an actuating state. When in a resting state, the camming bar actuator 19 is positioned approximately parallel to the handle 18. When in an actuating state, the handle is moved in an outward position from the creep frame 11. The camming bar actuator 19, which is pivotally secured to the parallel side rail 14, is then positioned approximately perpendicular to the handle 18. The motion of the handle 18 and camming bar actuator 19 provides a reciprocating motion to the parallel side rail 14 which acts upon the vertically creeper brake shoes 15 by a swivel-pivot linkage mechanism 28 which serves to coactively engage the brake shoe 15 to move into braking contact with a ground surface 17 underlying the creeper frame 11. As best illustrated in FIG. 11, the swivel-pivot linkage mechanism 28 has a tap or lobe 40 which co-acts with the frame cross bar 42 so that the rotative movement of the handle mechanism is restricted in its inward movement when the lobe 40 strikes the cross bar 42.

An opposite end of each responsive camming bar actuator 19 having a first camming bar actuator end 20 capable of being adapted through an eye-shaped upper pivot receiver 27 and engaged into an upper pivot 21 for movable attachment to an associated one of the handles 18. Preferably, the upper pivot 21 is welded to the first camming bar end 20. Alternatively, the upper pivot 21 and the first camming bar end 20 are threaded for threaded engagement. The camming bar actuator 19 has a second camming bar actuator end 24 pivotally mounted to the parallel camming bar 14. The means are actuated by the user physically manipulating the handle 18 which, in turn, actuates the responsive camming bar actuator 19 through the upper pivot 21. The camming bar actuator 19 is independently attached to one of the associated parallel camming bars 14 by the responsive pivot 23 thereby connecting the interdependent movement of the handle 18 and the camming bar actuator 19 with the swivel-pivot linkage mechanism 28 serving to coactively engage an associated one of the shoes 15 causing the shoes 15 to move in a vertical motion relative to the parallel camming bars 14, placing the shoes 15 in ground engagement.

As best illustrated in FIG. 7 and 8, the responsive camming bar actuator 19 is free to actuate the parallel camming bars 14 and associated shoes 15 through the placement of a plurality of channel or tubular shaped rail guides 22 that are spot welded 26 to the creeper frame 11 which allow the responsive camming bar actuator 19 to actuate both the parallel camming bars 14 as well as the associated vertically movable creeper brake shoes 15. A protective cover plate 29 is further provided to be secured over the parallel side rail 14 and mounted to the creeper frame 11 by a plurality of screws 30 extending through the cover plate 29 and into the creeper frame 11. As shown in FIG. 7, the frame 11 has a bracket 44 on each front frame end 46 of the frame 11. The bracket 44 allows the creeper structure 10 to be tilted up vertically for storage so that the creeper structure 10 rests on the brackets 44.

It is contemplated that, according to important features of my invention, I have disclosed the creeper structure 10 of my invention wherein the pair of independently operated handles 18 are angled away from the parallel camming bars 14 when positioned to the creeper brake shoes 15 in ground engagement. Furthermore, it will be appreciated that my creeper structure 10 also discloses the feature wherein the handles 18 are in generally parallel relation to one another and parallel to the parallel camming bars 14 when the creeper brake shoes 15 are in the storage position. Still further, my creeper structure 10 discloses a feature wherein the handles 18 are angled away from the side rails 14 when positioned with the creeper brake shoes 15 in ground engagement and being in generally parallel relation to one another and parallel to the parallel camming bars 14 when the creeper brake shoes 15 are in the storage position.

According to other important features of my invention, I have disclosed in combination, a creeper structure 10 including a creeper frame 11, a pad structure 12 on the frame 11, swivel-like mounted casters 13 secured to the frame 11 beneath the pad structure 12. It will be appreciated that the pad structure 12 can be provided with a padded cushion for the mechanic's comfort having a durable surface and that the swivel-like mounted casters 13 can be disposed on a horizontal plane with the creeper frame 11. My combination further comprises parallel camming bars 14 positioned on opposite sides of the pad structure 12 and vertically movable creeper brake shoes 15 mounted on the creeper frame 11 beneath the pad structure 12 for ground engagement. I have provided for means independently connected to each of the parallel camming bars 14 and connected to the vertically movable creeper brake shoes 15 for causing an associated one of the vertically movable creeper brake shoes 15 to move into braking contact with a ground surface 17 underlying the creeper frame 11. The means that I have disclosed can be contemplated as a responsive camming bar means, a gear means, a sliding gear means capable of being and disengaged, or where the sliding gear is linked to a slideable spring loaded cylinder capable of maintaining the gear means in an engaged position.

My invention also contemplates a pair of individually hand operated handles 18 supported on the creeper frame 11 for individually and independently actuating an associated one of the means mounted in the parallel camming bars 14 as well as an associated one of the vertically movable creeper brake shoes 15 causing the shoes 15 to move up into a storage position and down into a ground engagement position. Hence, another important feature of my invention discloses the combination wherein the handles 18 are angled away from the side rails 14 when positioned to the creeper brake shoes 15 in ground engagement.

Further, my invention comprises the combination wherein the handles 18 are in generally parallel relation to one another and parallel to the parallel camming bars 14 when the creeper brake shoes 15 are in the storage position. Thus, another important feature of my combination is disclosed wherein the handles 18 are angled away from the side rails 14 when positioned with the creeper brake shoes 15 in ground engagement and being in generally parallel relation to one another and parallel to the parallel camming bars 14 when the creeper brake shoes 15 are in the storage position.

Figure 2:
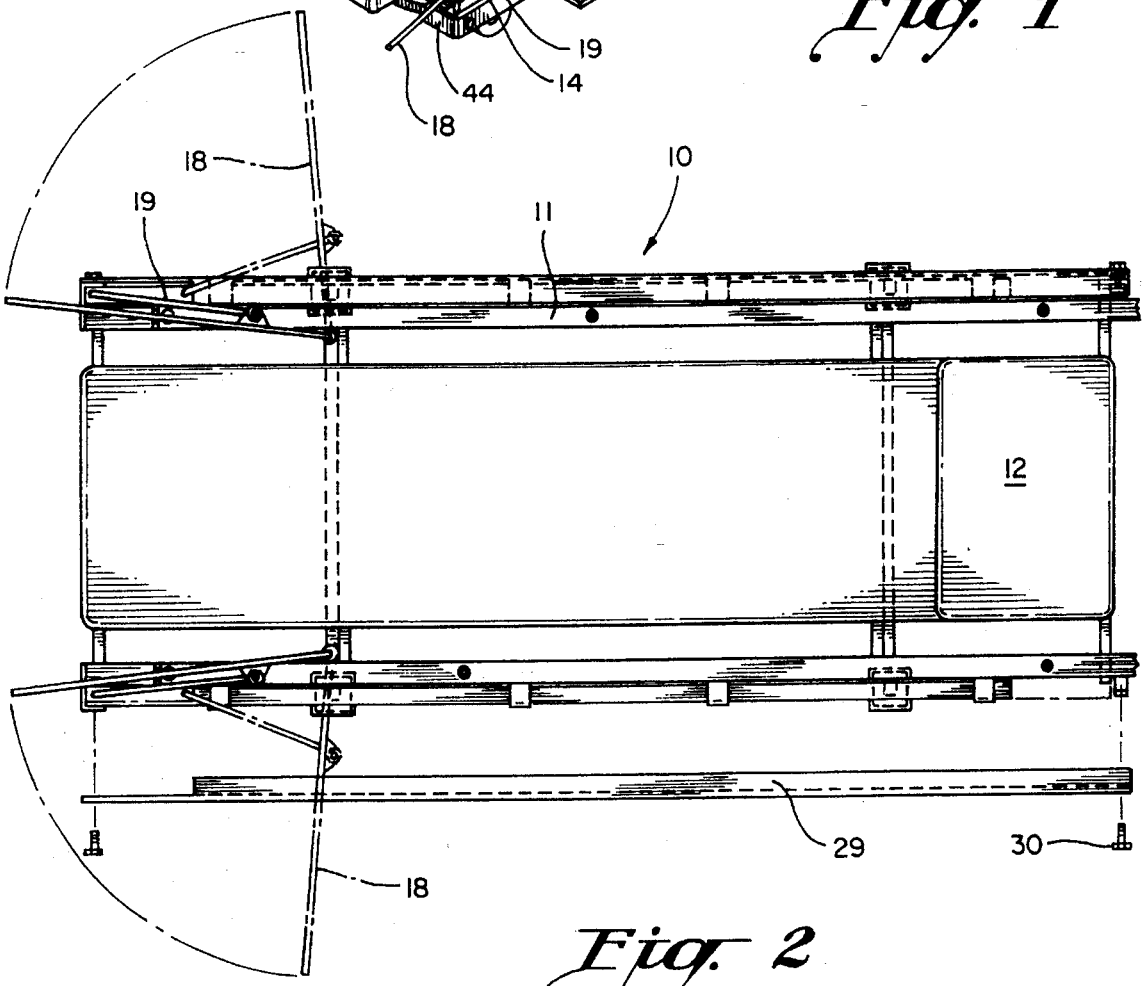
FIG. 2 is a partially exploded top sectional view of my creeper structure wherein the handles are angled away from the parallel side.
Figure 3:
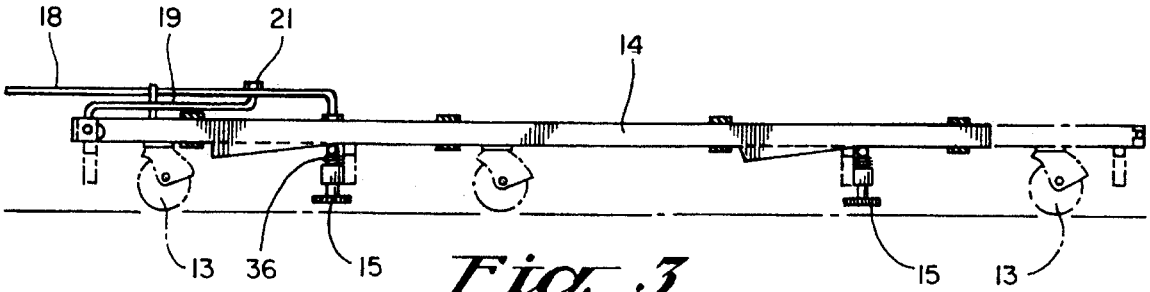
FIG. 3 is a partial side view of my creeper structure wherein the creeper brake shoes are in the storage position.
Figure 4:
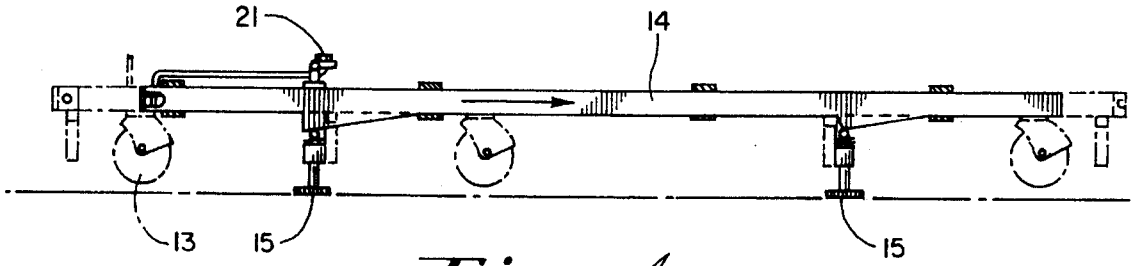
FIG. 4 is a partial side view of my creeper structure wherein the creeper brake shoes are in ground engagement.
Figure 5:
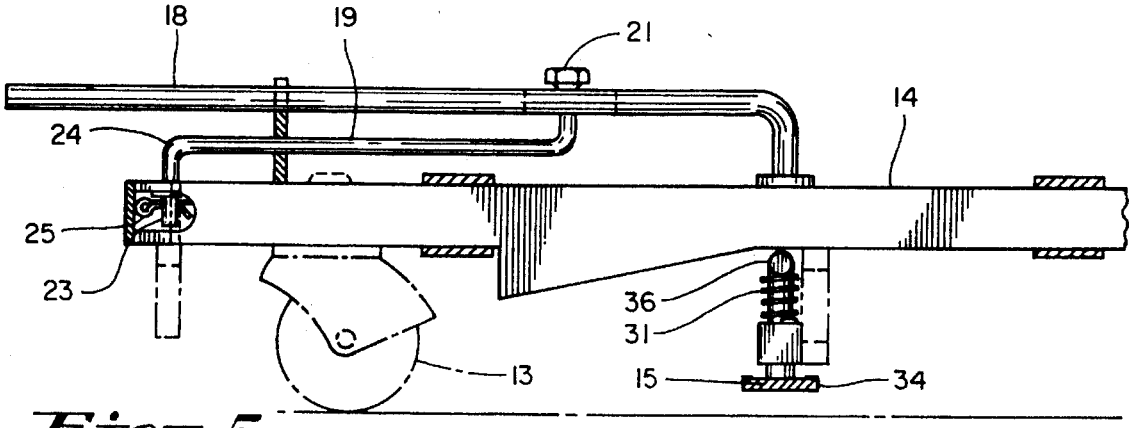
FIG. 5 is a side view of my creeper structure wherein the handles are in generally parallel relation to one another and parallel to the parallel camming bars when the creeper brake shoes are in the storage position.
Figure 6:
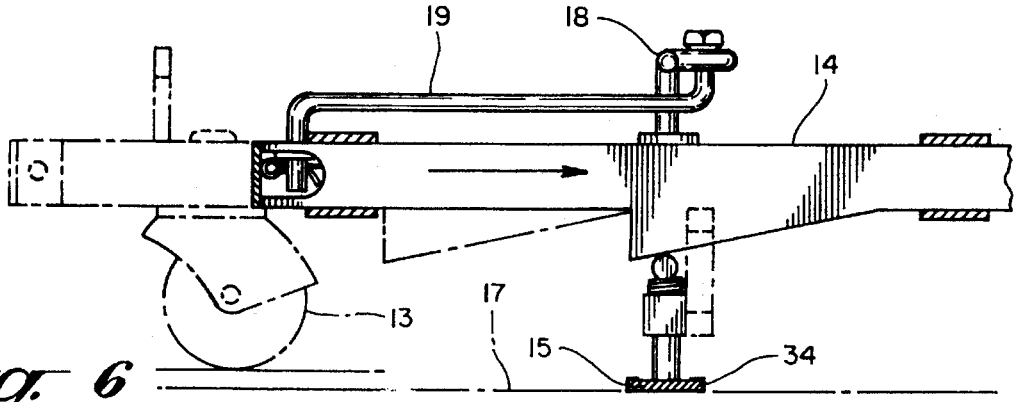
FIG. 6 is a side view of my creeper structure wherein the handles are angled away from the side rails when positioned to the creeper brake shoes in ground engagement.

Taking the aforementioned description in conjunction with the appended drawings it will be appreciated that the creeper structure 10 of my invention as seen in FIG. 1 and FIG. 2 is positioned for use by the mechanic wherein the user manually grasps a pair of individually hand operated handles supported 18 supported on the creeper frame 11 for individually and independently actuating an associated one of the responsive camming bars actuator 19 mounted on the parallel camming bars 14 as well as an associated one of the vertically movable creeper brake shoes 15 causing the associated one of the shoes 15 to move up into a rest position and down into a ground engagement position by the actuation of the swivel-pivot linkage mechanism 28. As seen in FIG. 3 and FIG. 5, the creeper structure 10 maintains a storage position wherein the handles 18 are in generally parallel relation to one another and parallel to the parallel camming bars 14 when the creeper brake shoes 15 are in the storage position. It will be appreciated that, in this storage position, the creeper structure 10 is manually movable by the swivel-like mounted casters 13, as seen in FIG. 5. However, as seen in FIG. 2 and FIG. 4 when the handles 18 are manually angled away from the parallel camming bars 14 the creeper brake shoes 15 are deployed into the ground engagement position as seen in FIG. 4 and FIG. 6. Once in the ground engagement position, the mechanic is free to ergonomically and comfortable effectuate repairs upon a disabled vehicle.

Turning now to FIG. 7, other important features of my invention will be appreciated in that I have provided that the means independently connected to each of the parallel camming bars 14 and connected to an associated one of said vertically movable creeper brake shoes 15 can comprise a responsive camming bar actuator means 19 independently connected to each of the parallel camming bars 14 by a responsive pivot 23 and key-shaped linking member 25 and connected to an associated one of the vertically movable creeper brake shoes 15. The responsive camming bar actuator 19 has a first camming bar actuator end 20 at an end adjacent to the handle 18 and is attached to the handle 18 by welding the first camming bar end 20 to the upper pivot 21. The responsive camming means 19 is actuated into a coactive camming position by the pair of individually hand operated handles 18 supported on the creeper frame 11 wherein each of the handles 18 independently actuates one of the responsive camming means 19 connected to the parallel camming bars 14 causing a coactive camming effect of the swivel pivot linkage mechanism 28 wherein the camming effect causes the associated one of the vertically movable creeper brake shoes 15 to move up into a storage position and down into a ground engagement position with a ground surface 17. The coactive camming effect is accomplished by allowing the responsive camming bar actuator 19 to actuate both the parallel camming bars 14 and the vertically movable creeper brake shoes 15 through a plurality of channel shaped rail guides located on the parallel camming bars 14 which are spot welded 26 to the creeper frame 11. According to these important features of my invention, it will be seen that when the handles 18 are angled away from the parallel camming bars, the responsive camming bar actuator 19 independently connected to each of the parallel camming bars 14 and connected to an associated one of the vertically movable creeper brake shoes 15 will coactively cam the associated one of the vertically movable creeper brake shoes 15 into downward movement thereby camming the associated one of the vertically movable creeper brake shoes 15 into a ground engagement position relative to a ground surface 17. Further, when the handles 18 are in generally parallel relation to one another and parallel to the parallel camming bars 14, the responsive camming means 19 independently connected to each of the parallel camming bars 14 and connected to an associated one of the vertically movable creeper brake shoes 15 will coactively cam the associated one of the vertically movable creeper brake shoes 15 into upward movement thereby camming the associated one of the vertically movable creeper brake shoes 15 in a storage position beneath the creeper frame 11 and away from the ground surface 17. It will be appreciated that when the creeper structure 10 is in this storage position, the entire creeper structure 10 can be physically moved and manipulated by the mechanic by use of the swivel-like mounted casters 13 secured to the creeper frame 11 beneath the pad structure 12.

The foregoing discussion discloses and describes merely exemplary embodiments of the present invention. One skilled in the art will readily recognize from such discussion, and from the accompanying drawings and claims, that various changes, modifications, and variations can be made without departing from the spirit and scope of the invention as defined in the following claims.

I claim:

1. In a creeper structure including a creeper frame, said frame being adapted for having a pad structure mounted thereon, swivel-like mounted casters secured to the frame beneath the pad structure, the improvement of parallel camming bars positioned on opposite sides of the pad structure, vertically movable creeper brake shoes mounted on said creeper frame beneath said pad structure for ground engagement, means independently connected to each of said parallel camming bars and connected to an associated one of said creeper brake shoes for causing an associated one of said creeper brake shoes to move into braking contact with a ground surface underlying the creeper frame, and a pair of individually hand operated handles supported on said creeper frame, each of said handles being connected to one of said parallel camming bars as well as an associated one of said creeper brake shoes causing the associated one of the shoes to move up into a storage position and down into a ground engagement position.

2. The creeper structure of claim 1 wherein said handles are angled away from said parallel camming bars when positioned to said creeper brake shoes in ground engagement.

3. The creeper structure of claim 1 wherein said handles are in generally parallel relation to one another and generally parallel to said parallel camming bars when said creeper brake shoes are in the storage position.

4. The creeper structure of claim 1 wherein said handles are angled away from the parallel camming bars when positioned with said creeper brake shoes in ground engagement and being in generally parallel relation to one another and parallel to said parallel camming bars when said creeper brake shoes are in the storage position.

5. The creeper structure of claim 1 wherein parallel side rails are attached at side margins of said creeper frame and extend endwise beyond an end of said creeper frame and said pad structure permitting said creeper structure to be rested on ends of the parallel side rails in an upright position.

6. The creeper structure of claim 1 wherein said swivel-like mounted casters are secured to said creeper frame and positioned in a horizontal plane, and a center most pair of the casters being longitudinally staggered relative to one another on opposite sides of the creeper frame.

7. The creeper structure of claim 1 wherein said means being independently connected to each of said parallel camming bars and connected to an associated one of said creeper brake shoes to move into braking contact with a ground surface underlying said creeper frame comprises a cam means.

8. The creeper structure of claim 7 wherein said creeper brake shoes are each spring loaded and each have an actuator head.

9. The creeper structure of claim 8 wherein said cam means is linked to a slideable spring loaded actuator head capable of maintaining said cam means in an engaged position, the spring loaded actuator head being attached to an associated one of said creeper brake shoes for actuating the same.

10. The creeper structure of claim 1 further comprising a pair of camming bar actuators, each camming bar actuator having a first end and a second end, the first end being pivotally mounted to an associated one of the individually hand operated handles, the second end being pivotally mounted to an associated one of said pair of parallel camming bars.

11. In combination, a creeper structure including a creeper frame, a pad structure on the frame, swivel-like mounted casters secured to the creeper frame beneath the pad structure, of parallel camming bars positioned on opposite sides of the pad structure, vertically movable creeper brake shoes mounted on said creeper frame beneath said pad structure for ground engagement, means independently connected to each of said parallel camming bars and connected to said creeper brake shoes for causing an associated one of said creeper brake shoes to move into braking contact with a ground surface underlying said creeper frame, and a pair of individually hand operated handles supported on said creeper frame, each of said handles being connected to one of said parallel camming bars as well as an associated one of said creeper brake shoes causing the shoes to move up into a storage position and down into a ground engagement position.

12. The combination of claim 11 wherein said handles are angled away from said parallel camming bars when said creeper brake shoes are moved into the ground engagement position.

13. The combination of claim 11 wherein said handles are in generally parallel relation to one another and parallel to said parallel camming bars when said creeper brake shoes are in the storage position.

14. The combination of claim 11 wherein said handles are angled away from said parallel camming bars when positioned with said creeper brake shoes in ground engagement and being in generally parallel relation to one another and parallel to said parallel camming bars when said creeper brake shoes are in the storage position.

15. The combination of claim 11 wherein said parallel camming bars being located on opposite sides of said creeper frame, tubular rail guide means is provided securing said parallel camming bars to said creeper frame, camming bar covers, attachment means joining said parallel camming bar covers to said creeper frame in overlying protective relation with respect to said camming bars and said tubular rail guides means.

16. The creeper structure of claim 11 wherein said swivel-like mounted casters are six in number and are secured to said creeper frame, a center pair of said swivel-like mounted casters being positioned in longitudinally staggered relation to stabilize the creeper structure when in ground engagement.

17. The creeper structure of claim 11 wherein said means independently connected to each of said parallel camming bars and connected to an associated one of said creeper brake shoes to move into braking contact with a ground surface underlying said creeper frame is a cam means.

18. The creeper structure of claim 17 wherein said cam means is a sliding cam being engaged and disengaged with an associated one of said creeper brake shoes.

19. The creeper structure of claim 11 further comprising a pair of camming bar actuators, each camming bar actuator having a first end and a second end, the first end being pivotally mounted to an associated one of the individually hand operated handles, the second end being pivotally mounted to an associated one of said pair of parallel camming bars.

20. In a creeper structure including a creeper frame, a pad structure on the creeper frame, swivel-like mounted casters secured to the creeper frame beneath the pad structure, the improvement of parallel camming bars positioned on opposite sides of the pad structure, vertically movable creeper brake shoes mounted on said creeper frame beneath said pad structure for ground engagement, responsive camming means independently connected to each of said parallel camming bars and connected to an associated one of said creeper brake shoes, and a pair of individually hand operated handles supported on said creeper frame, each of said individually hand operated handles independently actuating one of said responsive camming means connected to said parallel camming bars causing a coactive camming effect of an associated one of said vertically movable creeper brake shoes, said camming effect causing the associated one of said vertically movable creeper brake shoes to move up into a storage position and down into a ground engagement position with a ground surface.

21. The creeper structure of claim 20 wherein said creeper brake shoes are each spring loaded and each having an actuator head, said handles are angled away from said parallel camming bars causing said responsive camming means independently connected to each of said parallel camming bars and connected to an associated one of said actuator heads to coactively cam said associated one of said creeper brake shoes into downward movement thereby camming said associated one of said creeper brake shoes into a ground engagement position relative to a ground surface.

22. The creeper structure of claim 20 wherein said handles are in generally parallel relation to one another and parallel to said parallel camming bars causing said responsive camming means independently connected to each of said parallel camming bars and connected to an associated one of said creeper brake shoes to coactively cam said associated one of said creeper brake shoes into upward movement thereby camming said associated one of said creeper brake shoes in a storage position beneath the creeper frame and out of a ground engagement position relative to a ground surface.

23. The creeper structure of claim 20 wherein tubular rail guide means are provided securing said parallel camming bars to said creeper frame,

24. The creeper structure of claim 23 further including camming bar covers, attachment means joining said camming bar covers to said creeper frame in overlying protective relation with respect to said parallel camming bars and said tubular rail guide means.

25. The creeper structure of claim 20 wherein said responsive camming means further comprises a camming bar actuator for each of said parallel camming bars, each said camming bar actuator having a first end and a second end, the first end being pivotally mounted to the respective handle, the second end being pivotally mounted to the respective camming bar.

* * * * *